US008068753B2

(12) United States Patent
Kreiter et al.

(10) Patent No.: US 8,068,753 B2
(45) Date of Patent: Nov. 29, 2011

(54) CONTROL DEVICE AND METHOD TO CONTROL AN ELECTROPHOTOGRAPHIC PRINTER OR COPIER TO PREVENT DEVELOPER DAMAGE

(75) Inventors: Alexander Kreiter, Wörth (DE); Thomas Schwarz-Kock, Marzling (DE); Uwe Höllig, Munich (DE); Heinrich Lay, Töging am Inn (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 12/823,691

(22) Filed: Jun. 25, 2010

(65) Prior Publication Data

US 2010/0296846 A1 Nov. 25, 2010

Related U.S. Application Data

(62) Division of application No. 10/588,342, filed on Nov. 1, 2007.

(30) Foreign Application Priority Data

Feb. 6, 2004 (DE) ..... 10 2004 005 964

(51) Int. Cl.
*G03G 15/01* (2006.01)

(52) U.S. Cl. ..... 399/54; 399/228

(58) Field of Classification Search ..... 399/54, 399/55, 228, 223
See application file for complete search history.

(56) References Cited

U.S. PATENT DOCUMENTS 5,168,293 A 12/1992 Ogasawara et al.
5,400,123 A 3/1995 Sato et al.
5,585,898 A * 12/1996 Fujii ..... 399/228
5,828,934 A * 10/1998 Tamura et al. ..... 399/228
6,061,144 A 5/2000 Mamizuka
6,498,909 B1 12/2002 Reihl
6,647,233 B2 * 11/2003 Hiroki ..... 399/228
6,766,121 B2 7/2004 Nonaka et al.
6,768,880 B2 * 7/2004 Iida et al. ..... 399/55
6,778,798 B2 * 8/2004 Kitahara ..... 399/228
6,792,218 B2 9/2004 Tungate et al.
6,807,394 B2 * 10/2004 Yoo ..... 399/228
6,836,630 B2 * 12/2004 Owen et al. ..... 399/112

(Continued)

FOREIGN PATENT DOCUMENTS

DE 43 25 681 2/1994

(Continued)

OTHER PUBLICATIONS

Japanes Patent Abstract Publication No. 02018583 A, Date of publication of application: Jan. 22, 1990. Applicant Minlota Camera Co Ltd.

*Primary Examiner* — Robert Beatty

(74) *Attorney, Agent, or Firm* — Schiff Hardin LLP

(57) ABSTRACT

In a method or control device for controlling an electrophotographic printer or copier that has at least two developer stations, during a print operation print data is used to determine which developer stations are needed for printing of the data. In the event it is established that a developer station was not need or will not be needed for a predetermined time span, the developer station is shifted into a standby state in which at least one part of mechanical actuators of the developer station is stopped.

18 Claims, 7 Drawing Sheets

U.S. PATENT DOCUMENTS

| | | | | |
|---|---|---|---|---|
| 7,050,733 | B2 * | 5/2006 | Saito et al. | 399/55 |
| 7,095,966 | B2 | 8/2006 | Adachi | |
| 2002/0044784 | A1 | 4/2002 | Kato | |
| 2004/0023142 | A1 | 2/2004 | Hulin et al. | |
| 2005/0175384 | A1 | 8/2005 | Manzer | |

FOREIGN PATENT DOCUMENTS

| | | | |
|---|---|---|---|
| DE | 196 43 135 | | 4/1997 |
| DE | 199 00 164 | | 7/2000 |
| DE | 100 41 621 | | 3/2002 |
| DE | 102 12 840 | | 10/2003 |
| JP | 07137350 | A | 5/1995 |
| JP | 08110703 | A | 4/1996 |
| JP | 09138540 | A * | 5/1997 |
| JP | 10010865 | A | 1/1998 |
| JP | 11305636 | A * | 11/1999 |
| JP | 2000227695 | A | 8/2000 |
| JP | 2001075438 | A | 3/2001 |
| JP | 2001188394 | A | 7/2001 |
| JP | 2001356553 | A * | 12/2001 |
| JP | 2002328503 | A | 11/2002 |
| JP | 2003270958 | A | 9/2003 |

* cited by examiner

Start
70
50
Evaluate Page Buffer
72
Color Requirement ?
74
Yes
No
88
ts=0
ES In Standby ?
90
No
Yes
92
Exit
ts + ts + dt
76
80
Exit
Yes
ts ≤ tsmax ?
78
No
EFE Off ?
92
No
Yes
Activate EFE
94
Color Requiremnet For Further Colors Of The Print Path ?
81
Yes
No
Start ES Standby Admin.
82
Start ES Standby Admin.
84
Send Color Requirement To ES Standby Admin.
96
Deactivate EFE
86

Start
98
52
BD = 0
100
BD = DD + dBD
102
Color Requirement ?
104
Yes
No
BD ≤ τ ?
116
Yes
118
BD = 0
54
Color Standby
Pan ES Towards
Activate Developer
122
DB = τ ?
106
No
Yes
Activate Developer
108
Rüz = Rüz + R1
110
Pan ES Away
114
Rüz = ≤ x
112
No
Yes
BD = 0
124
48
Regeneration

CONTROL DEVICE AND METHOD TO CONTROL AN ELECTROPHOTOGRAPHIC PRINTER OR COPIER TO PREVENT DEVELOPER DAMAGE

RELATED APPLICATION

The present application is a divisional of U.S. Ser. No. 10/588,342 titled "Control Device And Method For Controlling An Electrophotographic Printer Or Copier" Kreiter et al, filed Nov. 1, 2007.

BACKGROUND

The preferred embodiment of the invention concerns a method for controlling an electrophotographic printer or copier that has at least one developer station for development of a latent charge image on a photoconductor with toner. It also concerns a control device for such a printer or copier.

Known methods of the aforementioned type typically provide different operating states or operating modes that the printer or copier can adopt in operation. Examples for such operating states are a standby mode in which the functional voltages and currents of the developer stations that are necessary for developing of charge images are typically deactivated and the mechanical actuators of the developer station are stopped. Such a standby mode is typically adopted when the printer or copier is turned on but no print data is present.

A further typical operating state is the print operation mode in which typically all functional voltages and currents of the developer stations are switched to nominal parameters and all actuators run with nominal parameters. Such a print operation mode is typically started as soon as print data are present and is maintained as long as the print data are present. During this print operation, as stated the actuators of all developer stations run in normal operation, meaning that all mixing devices (such as bucket wheels, paddlewheels, mixing dredgers and the like) for stirring the developer and all devices for applying the developer from the developer station onto the photoconductor are in operation during the print operation mode.

During such a print operation it can occur that one or more developer stations has only a very small toner discharge or even no toner discharge at all for a longer time period. In the present document, either a mixture of toner and carrier particles or a one-component developer is meant with the term "developer". In the case of the one-component developer, the terms "developer" and "toner" designate the same thing. The case of slight or disappearing toner discharge occurs relatively frequently in color printers or copiers in which a separate developer station is provided for each color component (cyan, yellow, magenta and black) and in fact when the print data do not contain a color component or contain a color component to only a limited extent for a longer time period. A prolonged low toner discharge can, however, also occur in one-color printers, namely when a plurality of successive print pages with little content is printed.

It has been shown that the developer ages or is damaged relatively quickly with prolonged low toner discharge, i.e. wears in the developer station and leads only to poor print results. In the case that a developer station is not required for a longer time period during the print operation, it is itself additionally subjected to an unnecessary wear.

SUMMARY

It is an object to specify a method and a control device of the aforementioned type that reduces the wear of the developer and/or of the apparatus.

In a method or control device for controlling an electrophotographic printer or copier that has at least two developer stations, during a print operation print data is used to determine which developer stations are needed for printing of the data. In the event it is established that a developer station was not needed or will not be needed for a predetermined time span, the developer station is shifted into a standby state in which at least one part of mechanical actuators of the developer station is stopped.

DESCRIPTION OF THE PREFERRED EMBODIMENT

Figure 1:
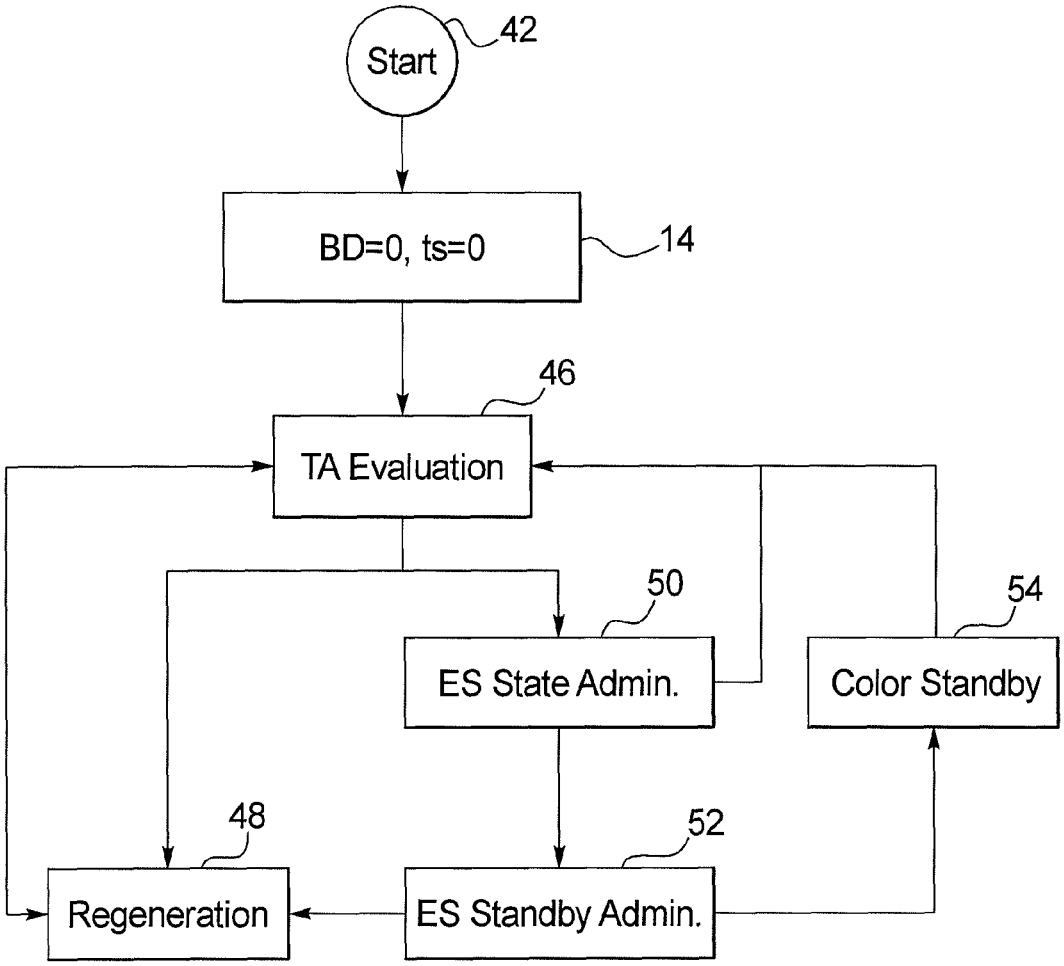
FIG. 1 is a block diagram that shows the components of a method according to a development of the invention.

For the purposes of promoting an understanding of the principles of the invention, reference will now be made to preferred embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

In the method according to the first aspect of the preferred embodiment, the toner discharge from the developer station is detected during the print operation and, for the case that the detected toner discharge fulfills a predetermined first regeneration criterion, a developer regeneration process is started in which a charge image on the photoconductor is generated, the charge image is developed by the developer station and the developed image is removed by a cleaning device without being transfer-printed onto a recording medium, and in which new toner is introduced into the developer station. The regeneration criterion is thereby initially not more narrowly limited; however, it is developed such that it indicates a prolonged low toner discharge.

In the framework of the solution of the preferred embodiment, the developed charge image can be directly removed from the photoconductor by a cleaning device; however, it can also initially be wholly or partially transfer-printed onto an intermediate carrier and be removed from this by a cleaning device. It is deliberately left open whether it is a cleaning device of the photoconductor, of a possibly-used intermediate carrier or of both. It is merely significant that the developed image is neither directly nor indirectly transfer-printed onto a recording medium in the developer regeneration process.

A wear or a damaging of the developer can thus be prevented via this method in that the toner discharge is monitored, and in that an artificial toner throughput is caused in the developer regeneration process for the case that the toner discharge is persistently low. For this, in the developer regeneration process an "artificial" or "random" charge image is generated on the photoconductor, the charge image being developed by the developer station and new toner is introduced into the developer station. The developed image is not transfer-printed onto a recording medium, so that no recording medium waste arises. Instead of this the developed image is removed from a cleaning device, as is explained in detail below.

The first regeneration criterion is selected such that it initiates the regeneration process in a timely manner before the developer is damaged or ages, however not unnecessarily early in order to keep the toner waste low and to not unnecessarily interrupt the print operation. Typical properties of the printer or copier and of the developer and empirical values typically enter into the selection of the first regeneration criterion.

In an advantageous development of the method, the toner discharge is determined for time intervals of predetermined length and the first regeneration criterion is fulfilled when the average toner discharge lies below a predetermined threshold for a predetermined number of successive time intervals. Given a suitable length of the intervals, a temporarily-increased toner discharge in a phase with otherwise-low toner discharge that is not sufficient in order to regenerate the developer in the long term is not sufficient in order to raise the average value of the toner discharge over this threshold for this interval. In such a case, the requirement for a regeneration process is furthermore viewed as existing. Contrarily, when the average value of the toner discharge lies above the threshold during one of these intervals, it is assumed that the developer was sufficiently regenerated and it needs no further regeneration process for the time being.

The toner discharge is advantageously determined using print data. The pixel count printed or to be printed is thereby advantageously added up, weighted with its inking level. This represents a (technically) very simple manner to determine the toner discharge from the developer station.

When the printer or copier comprises a plurality of developer stations, the toner discharge of each of these developer stations is advantageously detected and, for the case that the developer regeneration process is started for one developer station, it is checked whether the detected toner discharge of the remaining developer stations fulfills a second regeneration criterion, and a developer regeneration process is likewise started for developer stations in which the second regeneration process is fulfilled. The second regeneration criterion indicates that a developer regeneration process is in fact not yet required, however but could be required in the foreseeable future. Since the print operation must be interrupted for every regeneration process, it is advantageous to execute a plurality of regeneration processes in immediate succession in this manner, i.e. to temporally concentrate that regeneration processes.

The second regeneration criterion can be a weakened or, respectively, less restrictive version of the first regeneration criterion. In connection with the aforementioned advantageous example for the first regeneration criterion, the second regeneration criterion can require that the average toner discharge lies below a predetermined threshold for a predetermined number of successive time intervals that is less than the number of time intervals in the first regeneration criterion.

The method according to the second aspect of the preferred embodiment concerns printers or copiers that have at least two developer stations for development of a latent charge image on a photoconductor. According to the second inventive aspect, during the print operation it is determined using the print data which developer stations are necessary for printing of the data, and in the event that it is established that one developer station was not or is not necessary for a predetermined time span this developer station is set into a standby state in which at least one part of the mechanical actuators of the developer station is stopped.

In this standby state, the mechanical components of the developer station are thus conserved and their wear is reduced. At the same time, developer contained in the developer station is protected because this is damaged or aged via a perpetual mixing and activation that is implemented in the print operation. The second aspect is thus closely related with the first aspect of the preferred embodiment in terms of content. While the first aspect of the preferred embodiment concerns (as described above) a novel special operating state for regeneration and thereby for protection of the developer given prolonged low toner discharge, the second aspect of the preferred embodiment concerns a novel special operating state for protection of the developer and of the developer station for the case that the developer station is not required for longer than a predetermined time span.

In the standby state, the developer station is advantageously switched such that no toner transfer can occur between the developer station and the photoconductor, for example via suitable selection of the functional voltages and currents. In an advantageous development, the developer station is swiveled away from the photoconductor in the standby state.

The standby state is advantageously ended when it is established using the print data that the developer station is required for printing of the data. The print data are thereby advantageously, broadly, anticipatorily analyzed so that the time interval between the analysis of the print data and the point in time at which the image corresponding to these data is to be developed by the associated developer station is sufficient in order to shift this developer station from the standby state into the print operation state.

Typically, the developer in the developer station must be activated in order to be able to be transferred into the intermediate carrier to develop the latent charge image. Given a developer mixture made of toner and carrier particles, this activation typically exists in a stirring of the developer mixture in which the toner particles are triboelectrically charged on the carrier particles. During the standby state of a developer station, the developer contained therein is advantageously activated at predetermined intervals. The developer is then immediately ready for use when the developer station is returned from the standby state to the print operation state.

In an advantageous development, it is counted how often the developer has been activated during the standby state, and in the event that the number or the total duration of the activations exceeds a predetermined threshold no further activations are implemented for the duration of the standby state. Given standby states of shorter duration the developer then always remains functionally ready, while given standby states of longer duration activations are foregone in order to protect the developer.

As was already mentioned above, both aspects of the preferred embodiment are closely related and can be combined with one another in an advantageous manner as in the illustrated advantageous developments. For example, in an advantageous development that comprises both aspects of the preferred embodiment the developer is activated at predetermined intervals during the standby state of a developer station until the first regeneration criterion is fulfilled, whereupon no further developer activations are implemented in the developer station for the remaining duration of the standby state, and with the developer regeneration process the process waits until the developer station is required for developing or until another developer station of the printer or copier starts a developer regeneration process.

On the one hand the developer is protected in this manner during a longer standby state; on the other hand, the print operation is not interrupted for a developer regeneration process as long as the developer station is found in a standby state, i.e. until it is not required for developing. The regeneration processes can thus be better temporally concentrated and the number of the interruptions of the print operation can be reduced.

Figure 7:
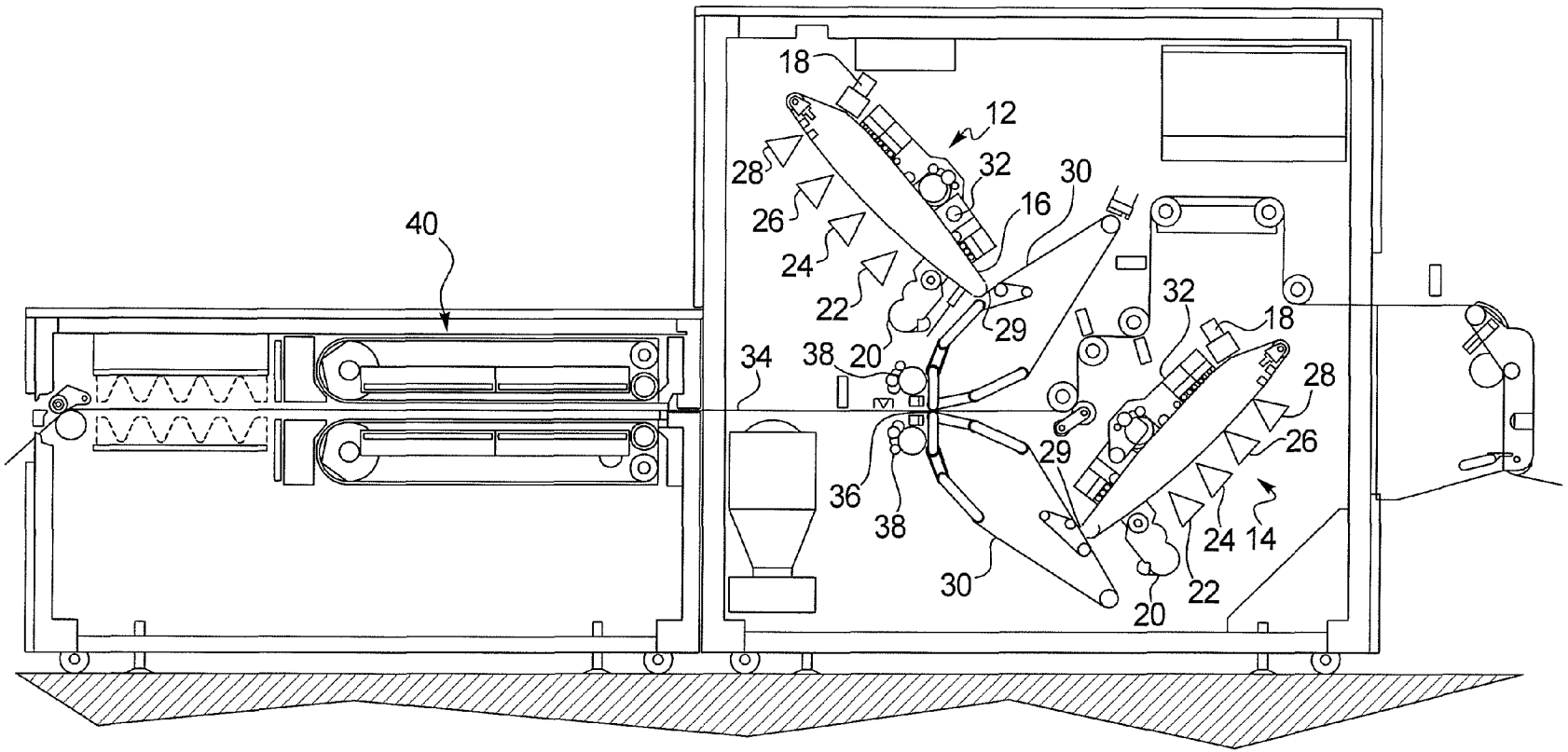
FIG. 7 is a section representation of a printer.

A printer 10 is shown in FIG. 7 in a section representation. The printer 10 has an upper printing group 12 and a lower printing group 14 that are designed identically and whose components are designated with the same reference characters. The printing groups 12 and 14 respectively have a photoconductor belt 16 that is electrically charged by a charging device (not shown in detail) and that is charged point-by-point via exposure by a character generator 18 for generation of a charge image.

The photoconductor belt 16 runs past five developer stations 20, 22, 24, 26 and 28, of which only that with reference character 20 is shown in detail in FIG. 7 and the remaining are symbolically represented by triangles. The developer stations 20 through 28 are respectively designated for development of a color component of a color image. The color components are advantageously formed by the colors cyan, yellow, magenta, black and a spot color; however, they can also be any other color.

For generation of a color component of a print image, a charge image that corresponds to the color component is generated on the photoconductor 16 by the character generator 18 and this charge image is developed with color toner by the associated developer station. The toner image of the color component so obtained is transfer-printed onto an intermediate carrier (here in the form of a transfer belt 30) at a first transfer printing point 29. However, an intermediate carrier drum can also be used as an intermediate carrier, for example. The residual toner remaining on the photoconductor 16 given the transfer printing is removed from the photoconductor belt 16 by a cleaning device 32. The photoconductor is subsequently re-charged, the charge image for a further color component is generated on the photoconductor 16 by the character generator 18, and is developed by the associated developer station 20, 22, 24, 26 or 28 and likewise transfer-printed onto the transfer belt 30, and in fact in such a way that the individual color components overlap into a multi-color image on the transfer belt 30.

Maximally five one-color images in the aforementioned component colors are thus superimposed into a multi-color image (color image) on the transfer belt 30. The transfer belt 30 is then panned to a paper web 34 and the color image is transfer-printed from the transfer belt 30 onto the paper web 34 at a second transfer printing point 36. In the representation of FIG. 7, the transfer belts 30 are shown in the state pivoted towards the paper web 34, in which the front side and the back side of the paper web 34 can be printed simultaneously.

The residual toner that remains on the transfer belt 30 after the transfer printing onto the paper web 34 is removed by a transfer belt cleaning device 38. The transfer-printed color images are then fixed on the paper web 34 in a fixing station 40.

Given a typical method for control of the printer 10, all developer stations 20, 22, 24, 26 and 28 are located in what is known as a "color standby state" during the print operation. During the color standby state, the developer stations 20, 22, 24, 26 and 28 are mechanically pivoted into an operating position on the photoconductor. All mechanical actuators of the developer stations run with nominal parameters. Actuators for mixing devices such as paddlewheels, mixing dredgers and/or screws as well as actuators for magnet rollers and further functional rollers for development of the charge image belong to the mechanical actuators. Only the functional voltages (i.e. the voltages that are necessary for toner transfer between the developer stations 20, 22, 24, 26 or 28 and the photoconductor belt 16) are still connected, such that no toner transfer can occur. The developer station can be brought from this color standby state into the development operation in the shortest time period, typically less than 0.2 seconds.

The continuous mixing of the developer with a paddlewheel, a screw or the like is necessary (as explained above) in order to activate the developer. Depending on the composition of the print data, however, it can be necessary that a color component is only weakly represented for a longer sustained time. This leads to a prolonged low toner discharge from the developer station associated with the color component. When the developer is continuously stirred given a prolonged low toner discharge, it is damaged in a relatively short time and allows only a poor print image quality. In particular the case can occur that a color component is not needed at all for a longer time period because the print data does not provide this color component for this time period. In this case the developer of the developer station (which is located in color standby) is also continuously activated and therefore damaged or subjected to an aging process. Moreover, the developer station is unnecessarily operated, which increases its wear.

The exemplary embodiment subsequently described shows a method for controlling the printer 10 that leads to a reduced wear of the developer and of the developer stations 20, 22, 24, 26 and 28. This method is implemented with the aid of an electronic control device that is not shown in the Figures.

The significant components of a method for controlling the printer 10 according to a development of the preferred embodiment are shown in a block diagram in FIG. 1. After a start in step 42, in step 44 the counters BD and is are initialized whose function is explained below. The controller subsequently proceeds to a toner discharge evaluation procedure 46 in which it is determined whether the toner discharge from the developer station to which this part of the controller corresponds has fallen below a predetermined value for a longer time period.

In the event that this is the case, a developer regeneration process 48 is started. In the event that this is not the case, the controller proceeds to a state administration 50 for the corresponding developer station. In the developer station state administration 50, it is checked whether the developer station has not been or will not be needed for a predetermined time span. In the event that this is not the case, the controller returns to the toner discharge evaluation 46. However, in the event that this is the case the developer station shifts into the standby state in which all or at least a part of the mechanical actuators of the developer station are stopped, and the controller proceeds to the developer station standby administration 52.

During the standby administration 52 it is checked whether a color requirement exists for the color of the developer station, i.e. whether the developer station will be needed in the foreseeable future. If this is the case, the controller proceeds to step 54, in which the developer station is brought into the color standby state described above. Under the circumstances explained in detail below, the standby administration 52 can also start a developer regeneration process 48 from a standby state.

Figure 2:
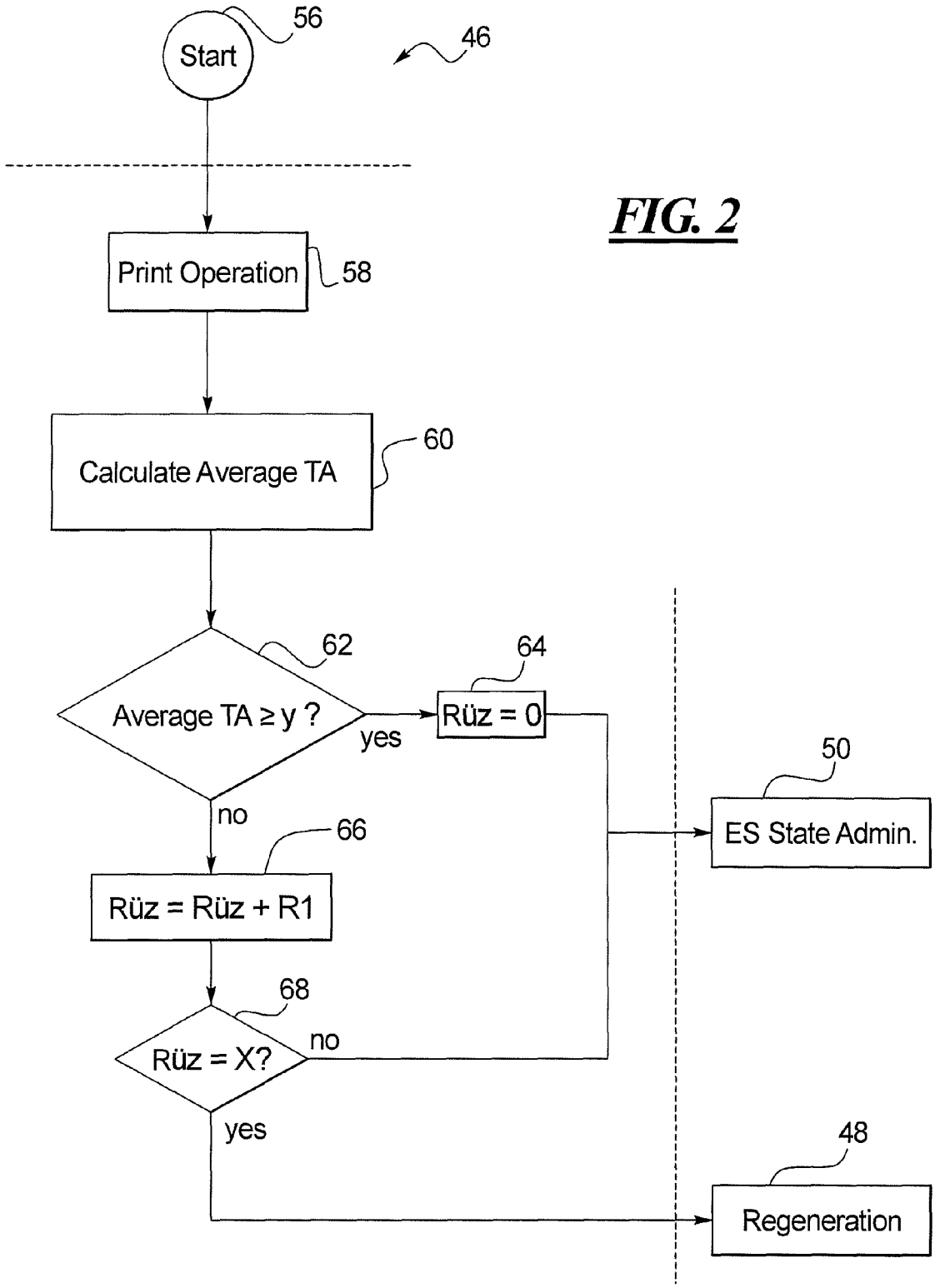
FIG. 2 is a flow diagram that shows a method for evaluation of the toner discharge.

A flow diagram of the evaluation procedure 46 of the toner discharge is shown in FIG. 2. After a start in step 56, the average toner discharge from the corresponding developer station for a time interval of predetermined length is determined in step 60 during the print operation 58. The determined average toner discharge is compared with a threshold y in step 62. In the event that the average toner discharge is greater than or equal to the threshold y, a regeneration monitoring counter (RÜZ) is set to 0 in step 64 and the controller proceeds to the developer station state administration 50 (see FIG. 1).

In the event that the average toner discharge in step 62 was less than the threshold y, RÜZ is increased by a first increment R1 in step 66. In step 68 it is then checked whether RÜZ lies above a threshold x. In the event that this is not the case, the controller likewise proceeds to the developer station state administration 50. However, in the event that RÜZ has reached the threshold x in step 68, a first regeneration criterion is fulfilled. This first regeneration criterion indicates that the average toner discharge has fallen below the threshold for a certain time duration. Given a longer sustained low toner discharge, the developer in the developer station would be damaged. In order to prevent that, the developer regeneration process 48 (see also FIG. 1) is accordingly started.

The normal print operation is initially interrupted in the developer regeneration process 48 (not shown in the diagrams). The character generator 18 (see FIG. 7) generates an artificial charge image (i.e. a charge image not provided in the print data) on the photoconductor 16 that is formed as a whole-area pattern with an areal coverage of 10% to 50%. The developed charge image is transfer-printed onto the transfer belt 30 at the first transfer printing point 29 (see FIG. 7).

In a manner different than given the typical transfer printing during the print operation, in a first embodiment variant the voltages and currents relevant for the transfer printing at the first transfer printing point 29 are connected such that only approximately 50% of the toner image is transfer-printed from the photoconductor 16 onto the transfer belt 30. The transfer belt 30 is moreover moved forward (i.e. pivoted away) from the transport path of the paper web 34 so that no toner arrives on the paper web 34 from the transfer belt 30. Instead of this, the transfer-printed portion of the toner image is cleaned off of the transfer belt 30 by the transfer belt cleaning device 38. The portion of the toner image that is not transfer-printed is cleaned from the photoconductor 16 by the photoconductor cleaning device 32 in a similar manner. Due to the transfer printing efficiency of approximately 50% at the first transfer printing point 29, the cleaning work is uniformly distributed on both cleaning devices 32 and 38.

In a second embodiment variant, the voltages and currents relevant for the transfer printing at the first transfer printing point 29 are connected such that between 75% and 100% of the toner image is transfer-printed from the photoconductor 16 onto the transfer belt 30. This (in comparison to the first variant) proportionally larger transfer printing lends itself when toner markings are generated on the photoconductor 16 and are analyzed for calibration of the electrophotographic components. For correct analysis of the toner markings it is important that the photoconductor on which the toner marker is generated is free of residual toner. When the transfer printing efficiency from the photoconductor onto the intermediate carrier is relatively low in the developer regeneration process, the cleaning device 32 must clean relatively large amounts of toner from the photoconductor 16, such that potentially too much residual toner in order to be able to generate a reliable toner marker could still remain on the photoconductor 16 after a cleaning pass. In the second embodiment variant, a higher transfer printing efficiency of 75% to 100% is therefore selected in the developer regeneration process. The remaining less than 25% of the pattern can then be thoroughly cleaned by the cleaning device 32 in a cleaning revolution.

In the developer regeneration process 48, an artificial or random toner discharge from the developer station is caused. Moreover, a corresponding quantity of fresh toner is subsequently delivered into the developer station. Damage to, aging or a wear of the developer in the developer station is prevented by this artificial toner throughput.

To calculate the average toner discharge in step 60 of FIG. 2, the number of pixels in the color corresponding to the developer station are added up using the print data, weighted with their inking level. This represents a simple and sufficiently-precise method for determination of the toner discharge.

In the printer 10 of FIG. 7, the print data are additionally already stored in a page buffer (not shown) sometime before the point in time at which the image corresponding to these data is to be developed by the developer station.

Figure 3:
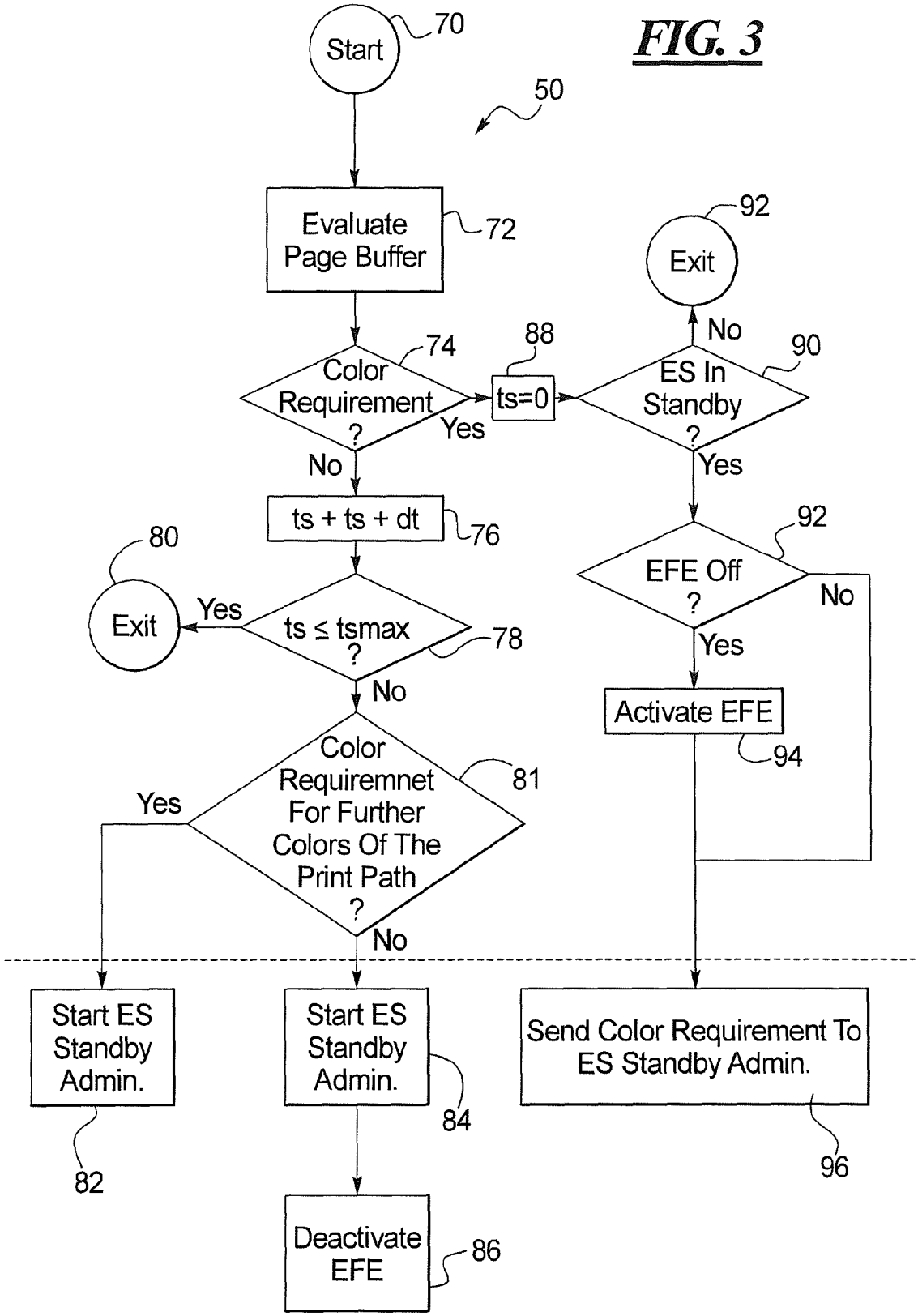
FIG. 3 is a flow diagram that shows a method for administration of states of a developer station.

A flow diagram of the developer station state administration 50 of FIG. 1 is shown in FIG. 3. After the start in step 70, the page buffer with the print data is evaluated in step 72. Using the print data in the page buffer, in step 74 it is established whether a color requirement exists for the corresponding developer station, i.e. whether print data are present that are to be developed with the color of the toner of the developer station. In the event that this is not the case, a counter ts is increased by an increment dt in step 76. In step 78 it is then checked whether the counter ts is smaller than or equal to a threshold tsmax. In the event that this is the case, the controller leaves the state administration 50 in step 80. In step 80 the controller could, for example, return to the toner discharge evaluation 46; however, the precise connection of the individual method parts is not specified in detail. In any case, the toner discharge evaluation 46 and the developer station state administration 50 can run parallel to one another.

However, in the event that the counter ts has reached the threshold tsmax in step 78, in step 81 it is initially checked whether color requirements exist for further colors of the print path. With regard to the printer 10 of FIG. 7, this means that it is verified whether further developer stations of the same printing group 12 or 14 are required. In the event that this is the case, in step 82 the controller starts the standby administration 52 (see FIG. 1) for the corresponding developer station and shifts this developer station into the standby state described above.

However, in the event that it was established in step 81 that no color requirements exist for all developer stations 20, 22, 24, 26 and 28 of the print path (i.e. printing group 12 or 14), in step 84 the standby administration 52 is likewise started and the developer station is shifted into the standby state. However, in step 86 the electrophotography device of the print path is additionally deactivated. With regard to the printer 10 of FIG. 7, this can occur, for example, when the paper web 34 is only simply printed (thus one of the printing groups 12 or 14 is not used). In this case, the electrophotography device of the printing group that is not required is shut down in order to conserve its components, for example the photoconductor 16, the character generator 18, the cleaning device 32 etc.

Stated briefly, the steps 76 through 86 of the state administration 50 have the effect that a developer station is shifted into the standby state when it was not needed for a longer time period, namely when ts is greater than tsmax. It can then be assumed with some probability that the developer station is also not needed for a further time period, such that it is worthwhile to shift it into the standby state in order to conserve its mechanical components.

When a color requirement for the corresponding developer station is established in step 74 of the state administration 50 of FIG. 3, the counter ts is set to 0 in step 88. In step 90 it is then checked whether the developer station is located in the standby state. In the event that this is not the case, the state administration 50 is left in step 92.

However, in the event that the developer station is located in the standby state, in step 92 it is checked whether the electrophotography device of the print path or of the printing group to which the corresponding developer station belongs is deactivated. In the event that the electrophotography device is deactivated, it is activated in step 94. In step 96 a color requirement is subsequently sent to the developer station standby administration 52.

Figure 4:
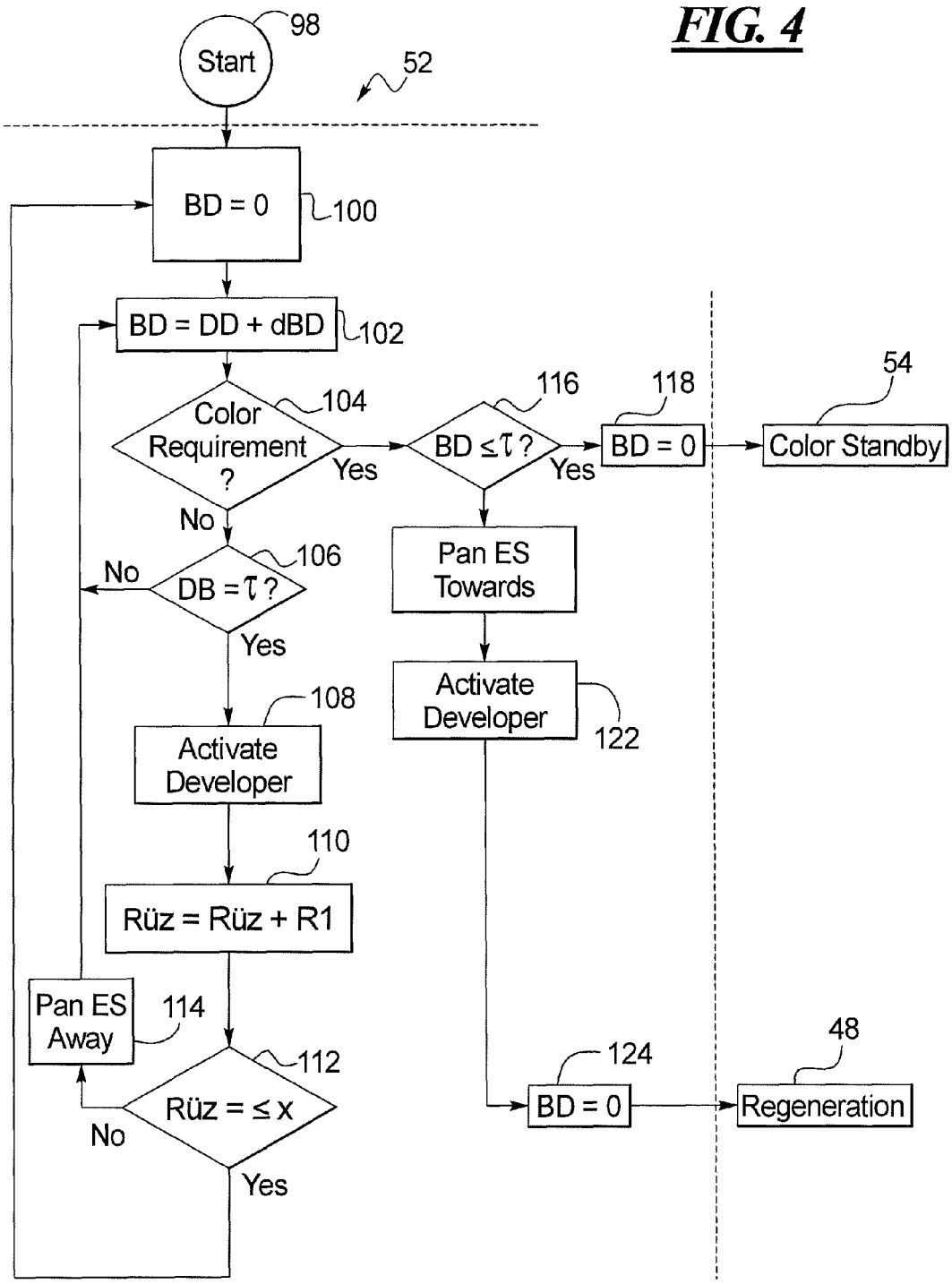
FIG. 4 is a flow diagram that shows a method for standby administration.

The developer station standby administration 52 of FIG. 1 is shown in a flow diagram in FIG. 4. After a start in step 98, a standby counter BD is initialized in step 100. In step 102, the counter BD is increased by the increment dBD. In step 104 it is checked whether a color requirement exists for the corresponding developer station.

In the event that this is not the case, in step 106 it is checked whether the counter BD corresponds to a threshold r. In the event that this is not the case, the controller returns to step 102.

When the counter BD has reached the threshold r, the developer in the developer station is activated in step 108.

In step 110 the regeneration monitoring counter (RÜZ) is increased by a second increment R2 that can be different from the first increment R1 from the step 66 of FIG. 2. In step 112 it is thereupon checked whether RÜZ is still smaller than the threshold x, i.e. whether the first regeneration criterion is fulfilled.

In the event that RÜZ is smaller than or equal to x in step 112, thus that a developer regeneration process is still not necessary, the controller returns to step 100. As long as no color requirement exists in step 104, the steps 100 through 112 are run through as described above. The developer is thereby activated at regular time intervals whose length is predetermined by the variable r (see step 108), whereby the developer is initially kept ready for use.

If in step 112 it is established that RÜZ has reached the threshold x, i.e. the first regeneration criterion is fulfilled, in step 114 the developer station is panned away from the photoconductor 16. Although the first regeneration criterion is fulfilled in this state, the regeneration process 48 (see FIG. 1) is not started for the time being. Instead of this, the controller proceeds to the step 102. In step 102 the counter BD is newly incremented by the increment dBD so that it is now greater than r. This has the result that the counter BD in step 106 is always greater than r, and thus the controller cyclically executes the steps 102, 104 and 106 until a color requirement exists in step 104. In particular no further activation of the developer is effected until further notice because the step 108 is no longer reached, whereby the wear and the aging of the developer is reduced.

In the event that a color requirement exists in step 104, in step 116 it is initially checked whether BD≦r. In the event that this is the case, no further activation of the developer is necessary. In step 118 the counter BD is then set to 0 and the developer station is shifted into the color standby state described above.

In the event that the counter BD in step 116 is greater than r, in step 122 the developer station is panned to the photoconductor 16 and the developer is activated in step 120. The counter BD is set equal to 0 in step 124 and the developer regeneration process 48 is started.

As is to be learned from the flow diagram of FIG. 4, in the standby state of the developer station a developer regeneration process 48 is delayed (in spite of fulfillment of the first regeneration criterion) until a color requirement exists in step 104, i.e. until the developer station is actually needed again. This has the advantage that the print process does not have to be unnecessarily interrupted. Rather, in this manner it is possible to synchronize the regeneration processes of different developer stations with one another, i.e. to optimally temporally concentrate as is explained in detail in the following under reference to FIG. 5.

Figure 5:
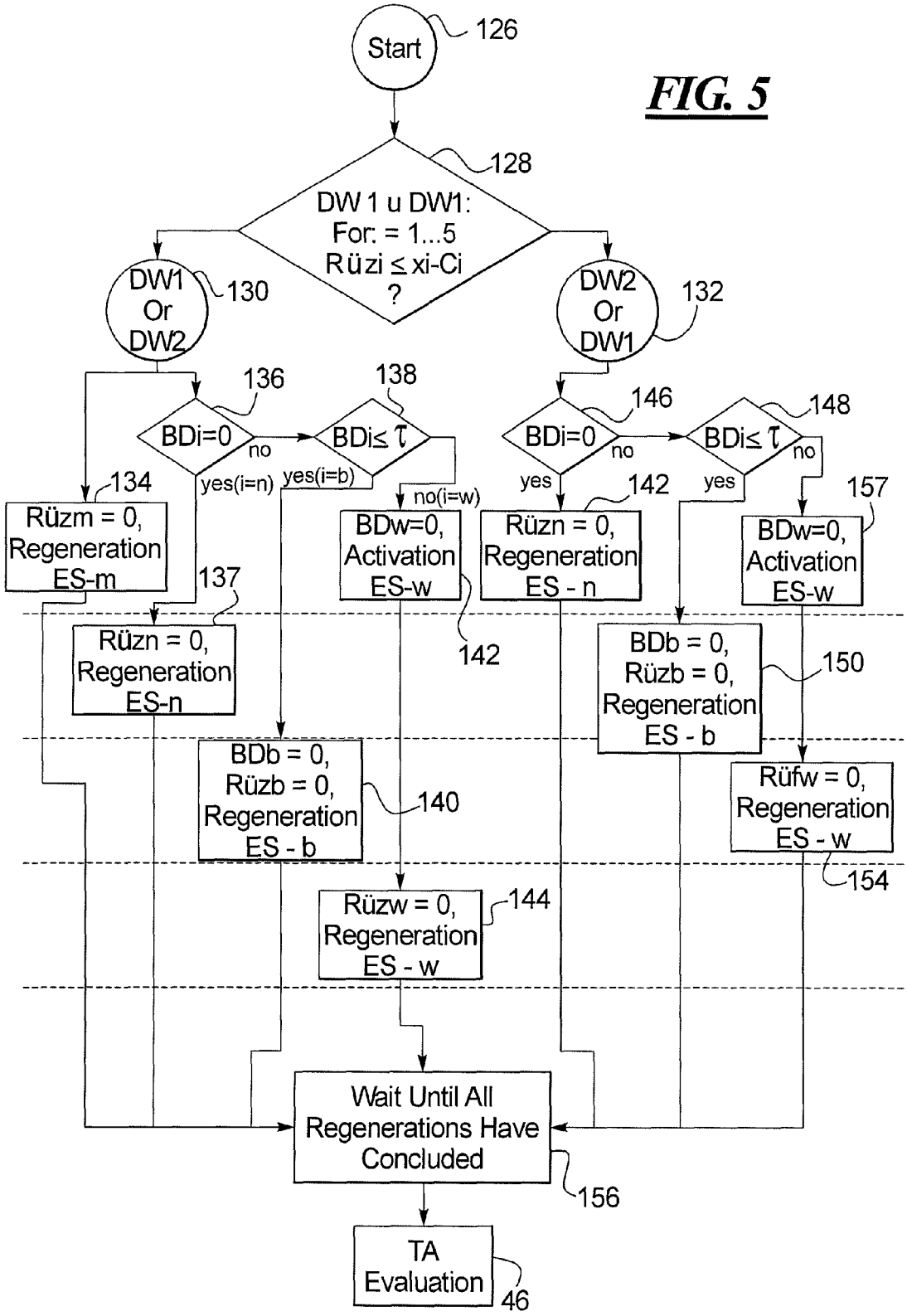
FIG. 5 is a flow diagram that shows the temporal synchronization of developer regeneration processes given a plurality of developer stations of a printer.

Using a flow diagram, FIG. 5 shows how the developer regeneration processes 48 of different developer stations can be synchronized with one another. The synchronization method begins in step 126 so that the regeneration process 48 is started for one of the five developer stations 20, 22, 24, 26 and 28 of the upper printing group 12 or of the lower printing group 14 (FIG. 7), for example via the step 68 in the toner discharge evaluation 46 of FIG. 2. The various developer stations of the printing group 12 or 14 are characterized by a control variable or index i, i=1 . . . 5 in the flow diagram of FIG. 5. The counters RÜZ and BD of the i-th developer station are likewise provided with the index i and thus become RÜZi and BDi.

In step 128, for all the developer stations i=1 . . . 5 (for the upper or first printing group 12 (DW1) and for the lower or second printing group 14 (DW2)) it is checked whether the associated regeneration monitoring counter (RÜZi)≦xi−ci. This inequality represents a second regeneration criterion for each developer station that is less restrictive than the first regeneration criterion, which generally has the form RÜZi=xi (see FIG. 2, step 68). At the threshold x the index i thereby indicates that different thresholds xi can exist for the different developer stations. ci is a positive number for each developer station i. The second regeneration criterion is accordingly fulfilled when a regeneration process is in fact presently not yet necessary in the i-th developer station, however would be necessary in the foreseeable future, which is represented by the variable ci.

In step 128 the controller branches into two branches, namely: a first branch that begins in step 130 and in which the chronological sequence of the regeneration processes of that printing group (DW1 or DW2) to which the developer station initiating the regeneration process belongs is established, and; a branch beginning in step 132 in which the order of the regeneration processes of the developer stations of the other printing group (DW2 or DW1) is established.

In the following, the developer stations 20, 22, 24, 26 and 28 are sub-divided into the following four classes according to their current state:

1. The developer station that has initiated the regeneration process. It is characterized in FIG. 5 by i=m. BDm=0 and RÜZm=xm applies for it.

2. Developer stations that are located in the toner discharge evaluation 46 and fulfill the second regeneration criterion. Such developer stations are characterized in FIG. 5 by i=n. BDn=0 and RÜZn≧xn−cn applies for them.

3. Developer stations that are located in the standby state, that fulfill the second regeneration criterion, but that do not fulfill the first regeneration criterion. Such developer stations are characterized in FIG. 5 by i=b. BDb≦rb and RÜZb≧xb−cb applies for them.

4. Developer stations that are located in the standby state, that fulfill the first regeneration criterion, however for which no color requirement exists. Such developer stations are designated with i=w. BDw>r and RÜZw>xw applies for them.

In the left branch of the flow diagram of FIG. 5, after the step 130 the developer regeneration process for the m-th developer station (i.e. for the developer station initiating the regeneration process) is started in step 134 and RÜZm=0 is set. Parallel to this, for all developer stations that fulfill the second regeneration criterion it is checked in step 136 whether BDi=0. In the event that this is the case, these developer stations are developer stations of the second class that have been characterized with i=n. For the developer stations of the second class, the developer regeneration process is started in step 138 with second temporal priority, i.e. immediately after the regeneration process of the initiating (i.e. m-th) developer station.

In the event that it is established in step 136 that BDi≠0, this developer station is located in the standby state and thus falls into the third or fourth class. So that a developer regeneration process can be implemented in such developer stations, these developer stations must initially be brought from the standby state into the color standby state. Since this can require some time, it is preferred to first implement the developer regeneration process for the developer stations of the first class and the second class, as is shown in FIG. 5. During the time required for this, the developer stations of the third class and the fourth class can then be brought from the standby state into the color standby state.

In step 138 it is additionally checked whether BDi≦r. In the event that this is the case, no toner activation is required for the corresponding developer station. The developer station thus belongs to the third class (i=b) and its developer regeneration process is implemented in step 140 with third temporal priority. Moreover, the variables or counters BDb and RÜZb are set equal to 0 in step 140.

In the event that BDi is greater than r in step 138, the developer station belongs to the fourth class (which is characterized by i=w). For it, in step 142 the toner is initially activated and BDw is set equal to 0. The developer regeneration process for these developer stations is subsequently started in step 144 with fourth (and thus least) temporal priority and the counter RÜZw is set equal to 0. The temporal preference of the developer stations of the third category relative to those of the fourth category is justified in that, given such developer stations of the fourth category, an additional toner activation is to be implemented that can be implemented while the end of the regeneration process of the developer station or developer stations of the third class is awaited.

The right branch of the flow diagram of FIG. 5 is essentially identical with the left branch except that here no developer station of the first class exists, of which there is always only one and which was dealt with in the left branch. In particular the steps 146 through 154 of the right branch correspond exactly to the steps 136 through 144 of the left branch. In step 156 it is awaited until all developer regeneration processes are concluded. The controller subsequently proceeds to the toner discharge evaluation 46.

Figure 6:
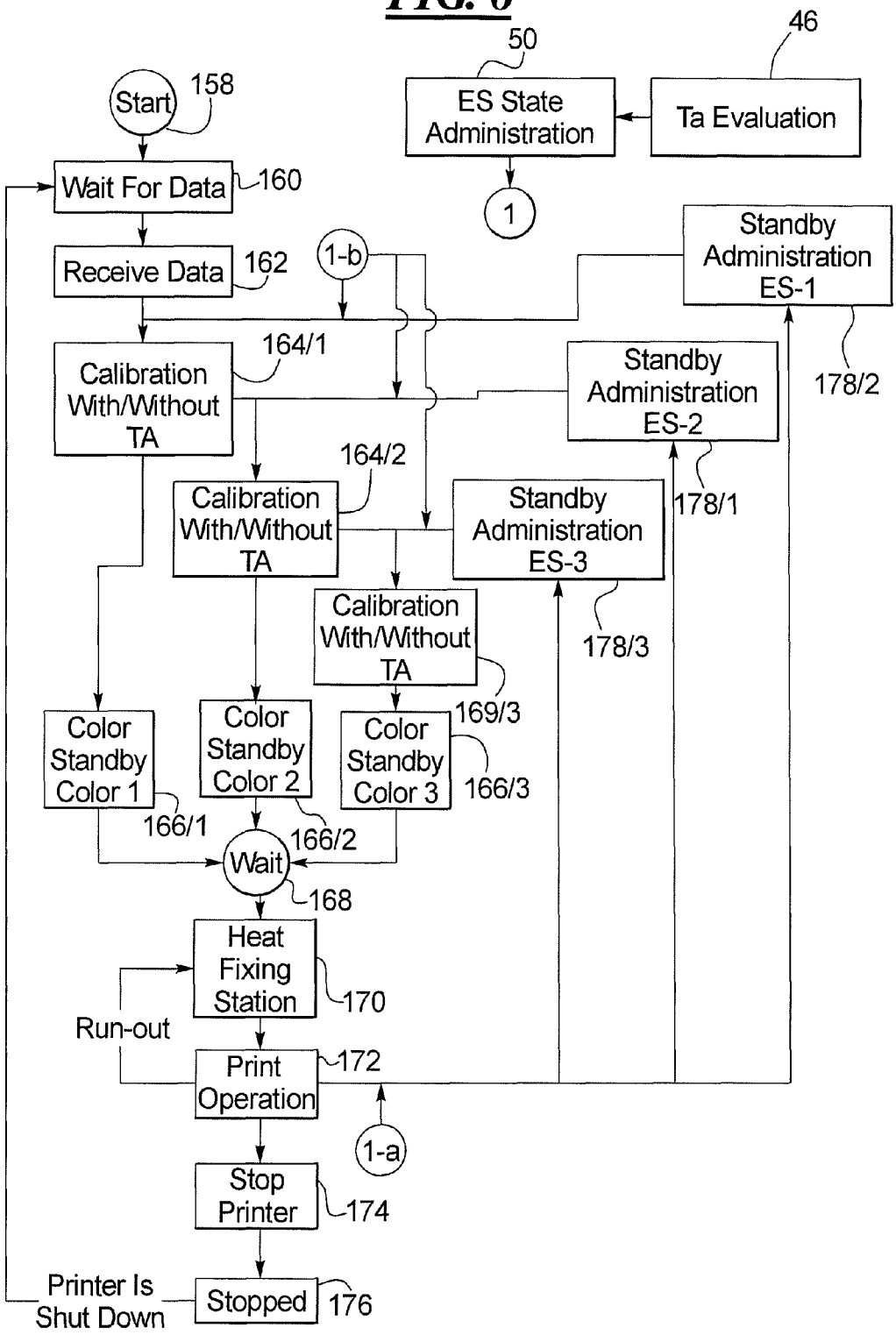
FIG. 6 is a flow diagram that shows the integration of a method according to a development of the invention into a conventional method for controlling a printer.

In FIG. 6 a flow diagram is shown using which the integration of the exemplary embodiment described in FIGS. 1 through 5 into a known controller for a printer is explained. The controller begins in step 158 with the switching-on of the printer 10. In step 160, the printer 10 is located in a standby mode and waits for data. After print data have been received in step 162, in the steps 164/1, 164/2 and 164/3 a calibration process without toner discharge is implemented in developer stations 1 through 3. For reasons of clarity, only three developer stations are considered in the flow diagram of FIG. 6 instead of the five developer stations per printing group of FIG. 7.

The calibration in step 164 is a preparation mode into which the printer 10 is brought before the beginning of the print operation. Operating parameters are calibrated in the calibration step 164. A transient effect is thereby implemented for control loops for regulation of operating parameters (which, for example, concern the charging of the photoconductor belt 16, the discharging of the photoconductor belt 16, the toner concentration in the developer mixture or the inking). After the end of the calibration in step 164, all three developer stations are brought back into the color standby state in steps 166/1 through 166/3.

In step 168 it is waited until all three developer stations have assumed the color standby state. In step 170 the heating of the fixing station 40 (see FIG. 7) is begun. In step 172 the printer 10 is found in the print operation in which print data exist. In the event that the print data are interrupted in the print operation, a short run-out begins. When the print data terminate for longer than the run-out time, the printer is halted in step 174. After the printer has been halted in step 176, the controller returns to step 160.

The toner evaluation 46 and the developer station state administration 50 run as independent processes in addition to the print operation (step 172) and are therefore executed separately in FIG. 6. The developer station state administration 50 anticipatorily analyzes the page buffer of the print data and affects the method in that it shifts unnecessary developer stations into the standby state or shifts the developer stations from the standby state into the color standby given the color requirement. The interaction of the developer station state administration 50 with the method from FIG. 6 is generally symbolized by the loop "1".

The state administration 50 in particular monitors the print data during the print operation (step 172) and shifts one or more of the developer stations 1 through 3 into the standby state in steps 178/1 through 178/3 (according to the method described in FIG. 3) when the counter is has reached the threshold tsmax (see FIG. 3, step 78). This effect on the print operation is symbolically represented by the loop "1-*a*" in FIG. 6. When a color requirements exists according to step 104 of FIG. 4, the developer stations are retrieved from the standby state by the state administration 50 and brought into the print process again via the calibration (step 164) and the color suspension bridge (step 166).

Blank pages are typically printed during the calibration (step 164), i.e. charge images are generated that can be developed but not transfer-printed. For example, in the course of the calibration toner markings can be printed that are not transfer-printed. However, in the typical calibration no whole-area toner patterns are generated on the photoconductor 16 as they are used in the developer regeneration process. This calibration is designated in FIG. 6 as "calibration without toner discharge" (see step 164).

In the event that a developer regeneration process is pending after the end of the standby state, this is realized in that the calibration is implemented with toner discharge in step 164. In this manner the regeneration process can be linked in a simple manner with a printer state or preparation mode that is provided anyway in the printer controller. Thus no new printer state must be implemented for the toner regeneration.

During the print operation (step 172), the toner discharge evaluation 46 can also establish whether the first regeneration criterion is fulfilled for a developer station that is not located in the standby state (see FIG. 2, step 68). In this case the print operation (step 172) is interrupted and the toner regeneration process is implemented in that the calibration in step 164 is implemented with toner discharge without shifting the developer station into the standby state beforehand. Moreover, the toner discharge evaluation 46 communicates the necessity of the regeneration process to the developer station state administration 50, which then takes on the synchronization of possible pending regeneration processes of the remaining developer stations according to FIG. 5.

Although a preferred exemplary embodiment is shown and described in detail in the drawings and in the preceding specification, this should be viewed as purely exemplary and not as limiting the invention. It is noted that only the preferred exemplary embodiment is shown and described, and all variations and modifications that presently or in the future lie within the protective scope of the invention should be protected.

We claim as our invention:

1. A method for controlling an electrophotographic printer or copier that has at least two developer stations with respective developers each comprising carrier and toner for developing a latent charge image on a photoconductor, each of said developer stations having at least one mechanical actuator for moving at least said toner, comprising the steps of:

during a print operation using print data to determine which developer stations are needed for printing of the data; and in the event it is established that at least one of said two developer stations will not be needed for at least a predetermined time span which is long enough to cause damage to the toner of the respective developer if it is moved by use of said mechanical actuator longer than said predetermined time span, changing said developer station into a standby state in which said at least one mechanical actuator of the developer station for the movement of said toner is stopped.

2. A method according to claim 1 wherein functional voltages of the developer station are connected in a standby state such that no toner transfer can occur between the developer station and the photoconductor.

3. A method according to claim 2 wherein the developer station is moved away from the photoconductor in the standby state.

4. A method according to claim 1 wherein the standby state is ended when, using the print data, it is established that the developer station is required for printing of the data.

5. A method according to claim 4 wherein the print data are broadly, anticipatorily analyzed so that a time interval between the analysis of the print data and a point in time at which the image corresponding to said data is to be developed by the associated developer station is sufficient in order to shift said developer station from the standby state into a print operation state.

6. A method according to claim 1 wherein during the standby state of the developer station the respective developer contained therein is activated at predetermined intervals.

7. A method according to claim 1 wherein at least two printing groups with respectively one separate electrophotography device are provided in the printer or copier, and wherein at least a part of the components of the electrophotography device is shut down when the last developer station of the printing group is shifted into the standby state.

8. A method for controlling an electrophotographic printer or copier that has at least two developer stations for developing a latent charge image on a photoconductor, comprising the steps of:

during a print operation using print data to determine which developer stations are needed for printing of the data;

in the event it is established that a developer station was not needed or will not be needed for a predetermined time span, shifting said developer station into a standby state in which at least one part of the mechanical actuators of the developer station is stopped;

the developer station being moved away from the photoconductor in the standby state; and the developer station being moved away from the photoconductor during the standby state when a temporal duration of the standby state exceeds a predetermined threshold.

9. A method for controlling an electrophotographic printer or copier that has at least two developer stations for developing a latent charge image on a photoconductor, comprising the steps of:

during a print operation using print data to determine which developer stations are needed for printing of the data;

in the event it is established that a developer station was not needed or will not be needed for a predetermined time span, shifting said developer station into a standby state in which at least one part of the mechanical actuators of the developer is stopped;

during the standby state of the developer station a developer contained therein is activated at predetermined intervals; and determining how often or how long the developer has been activated during the standby state, and in the event that a number of the activations or a duration of the activation exceeds a predetermined threshold, no further activations are implemented for a duration of the standby state.

10. A control device for an electrophotographic printer or copier that has at least two developer stations with respective developers each comprising carrier and toner for development of a latent charge image on a photoconductor, each of said developer stations having at least one mechanical actuator for moving at least said toner, said control device performing the functions of:

using print data during a print operation to determine which developer stations are required for printing of the data; and in the event that it is determined that at least one of said two developer stations will not be required for at least a predetermined time span which is long enough to cause damage to the toner of the respective developer if it is moved by use of said mechanical actuator longer than said predetermined time span, the developer station is changed into a standby state in which said at least one mechanical actuator of the developer station for the movement of said toner is stopped.

11. A control device according to claim 10 wherein in the standby state functional voltages of the developer station are connected such that no toner transfer can occur between the developer station and the photoconductor.

12. A control device according to claim 10 wherein the developer station is moved away from the photoconductor in the standby state.

13. A control device according to claim 10 that triggers that the standby state is ended when, using the print data, it is established that the developer station is required for printing of the data.

14. A control device according to claim 13 that is suited to broadly, anticipatorily analyze the print data so that a time interval between analysis of the print data and a point in time at which the image corresponding to said data is to be developed by the associated developer station is sufficient in order to shift said developer station from the standby state into a print operation state.

15. A control device according to claim 10 wherein during the standby state of the developer station the control device triggers that the developer contained therein is activated at predetermined intervals.

16. A control device according to claim 10 wherein at least two printing groups with respectively one separate electrophotography device are provided in the printer or copier, and the control device triggers that at least a part of the components of the electrophotography device is shut down when a last developer station of the printing group is shifted into the standby state.

17. A control device for an electrophotographic printer or copier that has at least two developer stations for development of a latent charge image on a photoconductor, said control device performing the functions of:

using print data during a print operation to determine which developer stations are required for printing of the data;

in the event that it is determined that a developer station has not been required or will not be required for a predetermined time span, the developer station is shifted into a standby state in which at least a part of mechanical actuators of the developer station is stopped;

the developer station being moved away from the photoconductor in the standby state; and the developer station is being moved away from the photoconductor during the standby state when a temporal duration of the standby state exceeds a predetermined threshold.

18. A control device for an electrophotographic printer or copier that has at least two developer stations for development of a latent charge image on a photoconductor, said control device performing the functions of:

using print data during a print operation to determine which developer stations are required for printing of the data;

in the event that it is determined that a developer station has not been required or will not be required for a predetermined time span, the developer station is shifted into a standby state in which at least a part of mechanical actuators of the developer station is stopped;

during the standby state of the developer station the control device triggering that the developer contained therein is activated at predetermined intervals; and the control device determining how often or how long the developer has been activated during the standby state and, when a number of the activations or a duration of the activation exceeds a predetermined threshold, the control device triggers that no further activations are implemented for a duration of the standby state.

* * * * *